US009359871B2

(12) United States Patent
White et al.

(10) Patent No.: US 9,359,871 B2
(45) Date of Patent: Jun. 7, 2016

(54) DEBRIS CATCHER FOR RETRIEVABLE BARRIER

(75) Inventors: Matthew L. White, Lakewood, CO (US); David A. Dolyniuk, Dickinson, ND (US); Steve Rosenblatt, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 338 days.

(21) Appl. No.: 13/412,149

(22) Filed: Mar. 5, 2012

(65) Prior Publication Data

US 2013/0228327 A1 Sep. 5, 2013

(51) Int. Cl.

| | |
|---|---|
| ***E21B 27/00*** | (2006.01) |
| ***E21B 43/08*** | (2006.01) |
| ***E21B 33/134*** | (2006.01) |
| ***E21B 34/14*** | (2006.01) |
| ***E21B 43/26*** | (2006.01) |

(52) U.S. Cl.

CPC ..... *E21B 43/08* (2013.01); *E21B 27/005* (2013.01); *E21B 33/134* (2013.01); *E21B 34/14* (2013.01); *E21B 43/26* (2013.01)

(58) Field of Classification Search

CPC ..... E21B 23/06
USPC ..... 166/162, 99, 227, 169, 179
See application file for complete search history.

(56) References Cited

U.S. PATENT DOCUMENTS

| | | | | |
|---|---|---|---|---|
| 2,228,242 | A | 7/1939 | Baker | |
| 2,927,644 | A * | 3/1960 | Caldwell | 166/99 |
| 4,928,762 | A * | 5/1990 | Mamke | 166/192 |
| 5,623,993 | A * | 4/1997 | Van Buskirk et al. | 166/292 |
| 6,220,348 | B1 * | 4/2001 | Serafin et al. | 166/133 |
| 6,220,349 | B1 * | 4/2001 | Vargus et al. | 166/138 |
| 6,302,217 | B1 | 10/2001 | Kilgore et al. | |
| 7,604,048 | B2 | 10/2009 | Kossa et al. | |
| 2004/0118564 | A1 * | 6/2004 | Themig et al. | 166/305.1 |
| 2005/0000692 | A1 * | 1/2005 | Cook et al. | 166/300 |
| 2007/0267196 | A1 | 11/2007 | Mondelli et al. | |
| 2009/0173489 | A1 * | 7/2009 | Bullard | 166/181 |
| 2010/0236833 | A1 * | 9/2010 | Hall et al. | 175/314 |
| 2013/0168091 | A1 * | 7/2013 | Xu et al. | 166/301 |

* cited by examiner

*Primary Examiner* — Robert E Fuller
*Assistant Examiner* — Steven MacDonald
(74) *Attorney, Agent, or Firm* — Steve Rosenblatt

(57) ABSTRACT

A basket is attached below a retrievable bridge plug used during the pressure testing of a well to verify integrity prior to fracturing operations. After the pressure integrity test above the plug, the plug is released and retrieved and a series of balls of increasing diameter are dropped on increasingly larger ball seats to allow shifting sleeves to an open position from the heel of the well toward the surface to sequentially frac in that direction. If any segments of the sealing element break off they are captured and removed in the basket that has flow through opening small enough to retain the debris and allow flow through the basket during removal. The basket is slotted for through fluid flow and can have a breakaway for the support rod if the basket sticks when the plug is removed.

17 Claims, 2 Drawing Sheets

DEBRIS CATCHER FOR RETRIEVABLE BARRIER

FIELD OF THE INVENTION

The field of the invention is subterranean barriers and more specifically packers or bridge plugs that are retrievable with a debris capture device that can collect pieces of the sealing element that peel off on release for removal of the barrier.

BACKGROUND OF THE INVENTION

Hydraulic fracturing is a common practice in unconventional oil and gas plays used to efficiently extract hydrocarbons from a formation. One method utilized in stage fracking is thru a series of sleeves with ball seats arranged smallest to largest with the smallest ball seat starting at the end of the well moving upwards in consistent increments. Typically before hydraulic fracturing is allowed to commence integrity of the well is confirmed using a retrievable bridge plug set above all the frac sleeves. After the plug is set and holds a predetermined amount of applied pressure, the plug is released and retrieved to the surface. Hydraulic stage fracturing then commences by dropping a series of balls of increasing diameter so that sleeves are shifted to expose frac ports in a direction from the end of the well towards the surface as incrementally larger balls are dropped. After the fracturing is completed with all the sleeves shifted, the well is put into production.

To speed delivery in some applications the retrievable bridge plug can be deployed and set on electric line with a setting tool that when triggered creates relative movement of a setting sleeve with respect to a tension mandrel acting to compress the sealing elements into contact with the surrounding tubular, generally casing. This action sets the bridge plug by generating sufficient force to packoff the element sealing rubbers thus creating a temporary plug. Typically these plugs have a ratchet locking system to hold the set position and trap setting force in place accomplished during the setting of the tool. After the plug is set, the setting tool features a mechanism that facilitates release of the electric line and adapter kit from the bridge plug. Alternatively the plug can be run in on coiled or jointed tubing depending on the well configuration and the locally available equipment.

To release such plugs the locking mechanism is defeated usually by a tool that breaks a shear pin and moves a sleeve that allows the well to equalize through a bypass featured on the bridge plug. After that happens the sealing element and slips extend axially and retract radially so that the packer or plug can be removed. What has been discovered is that the setting, applied pressure, pressure reversals and releasing process causes parts of the individual packing elements to break up and fall off. This can be devastating to the frac job which relies on a series of balls to seat on ball seats. With a chunk of rubber sitting on a ball seat the deployed balls may actuate the wrong frac sleeve. The debris could also prevent the ball from creating a seal against the ball seat. The debris can also land on one of the ball actuated seats or worst case even the upper most ball actuated seat. If debris lands on one of the frac sleeve ball seats the risk of premature or insufficient actuation is very high.

Debris barriers have been used before with packers to keep debris out of moving parts for packers that remain in a set position for a long time. The idea is to keep the parts that have to move relatively when the packer is released free of debris so that the packer components can actually allow for the removal of the packer. Some of these designs are U.S. Pat. Nos. 7,604,048; 6,302,217 and 2,228,242. U.S. Publication 2007/0267196 uses a magnetic plug that can also be a basket that goes into a packer seal bore and when later pulled out captures debris accumulated above a long set packer before the packer is released. None of these designs are intended to capture the debris and prevent it from advancing downhole. These designs deal with debris already in the wellbore as opposed to portions of the sealing element breaking off in service.

The present invention seeks to minimize the formation of debris from portions of the sealing element coming apart without inhibiting the performance of the sealing element as a barrier. Additionally if any debris is formed the debris is also retained in a basket supported by the plug or packer. The basket is preferably closely mounted to the packer sealing element and supported by the packer mandrel. The support rod can have a breakaway connection if the basket gets stuck to allow the plug to be removed. A fishing neck can be associated with the breakaway to facilitate subsequent fishing operations for the basket. Optionally the basket or rod can have an acceleration actuated break so that if the basket breaks loose from the packer the brake will prevent the basket from falling a substantial distance. Another option can be a travel stop on the setting mechanism that will limit the rubber pressure during the setting with an eye toward reducing the tendency to create debris due to the setting and subsequent differential pressure loading of the plug. Those and other features of the present invention will be more readily apparent to those skilled in the art from a review of the detailed description and the associated drawings while recognizing that the full scope of the invention is to be found from the appended claims.

SUMMARY OF THE INVENTION

A basket is attached below a retrievable plug used in fracturing. After the pressure integrity test above the plug, the plug is released and retrieved and a series of balls of increasing diameter are dropped on increasingly larger ball seats to allow shifting sleeves to an open position from the end of the well toward the surface to hydraulically stage frac in the desired direction. If any segments of the sealing element break off they are captured and removed in the basket that has flow through opening small enough to retain the debris and allow flow through the basket during removal. The basket is slotted for through fluid flow and can have a breakaway for the support rod if the basket sticks when the plug is removed. An acceleration brake can be associated with the basket to stop it from freefalling into the well. The rod is positioned so that if the tool comes off the bridge plug the gauge ring will catch at the largest upper most ball seat. The rod that is protruding up through the gauge ring then acts as a fishing neck and the entire assembly can be pulled from the well as one piece.

BRIEF DESCRIPTION OF THE DRAWINGS

FIG. 2 shows the whole assembly being run in;

DETAILED DESCRIPTION OF THE PREFERRED EMBODIMENT

Figure 1:
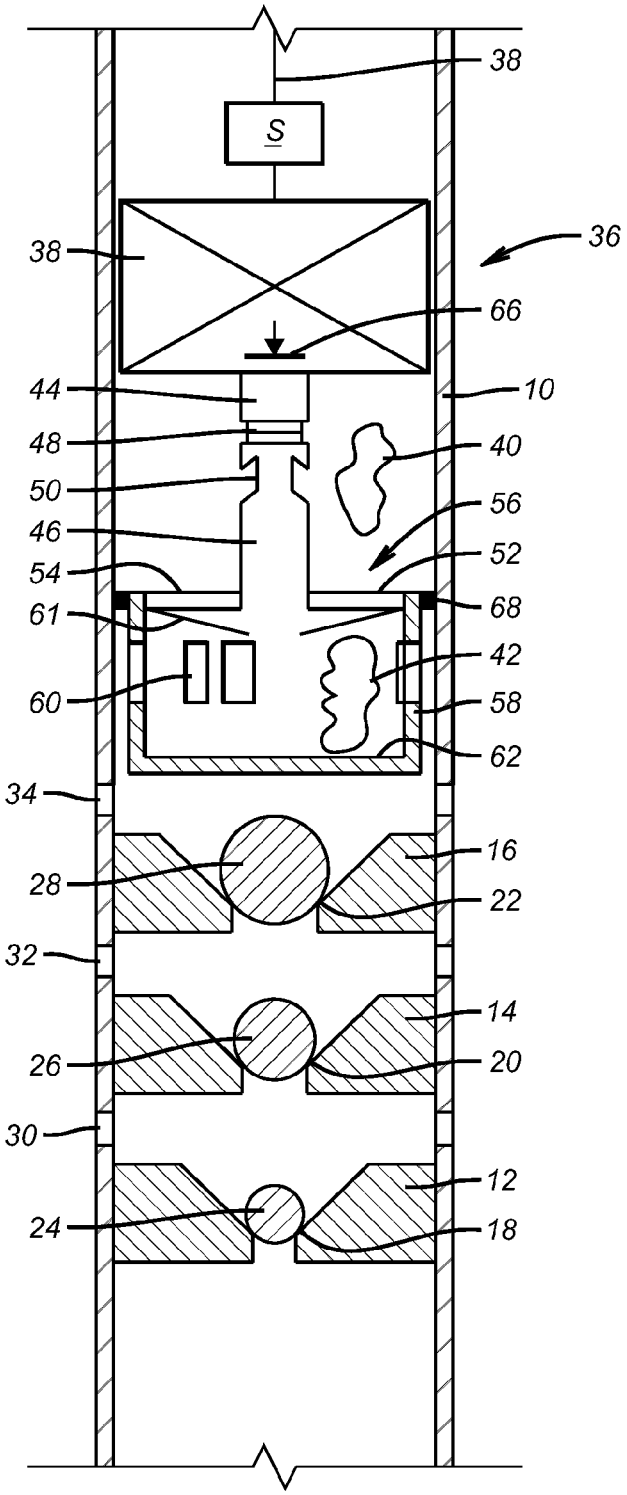
FIG. 1 schematically illustrates a released plug in a wellbore with the basket mounted below for catching debris.
Figure 2:
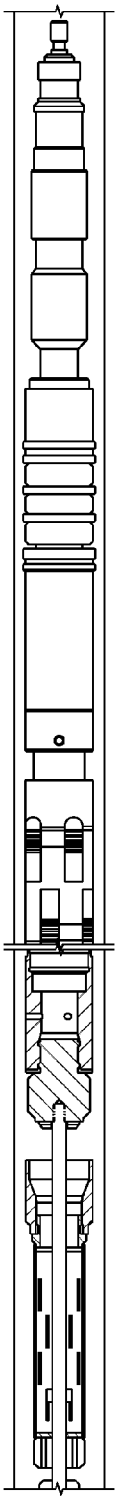
Figure 3:
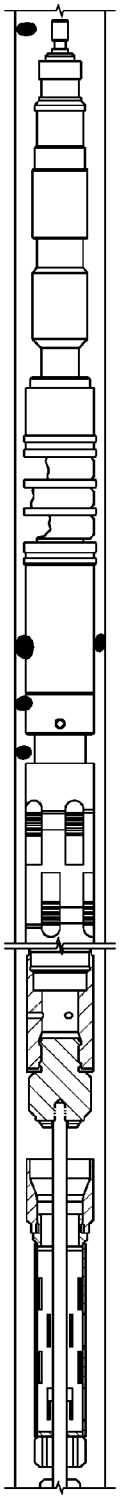
FIG. 3 is the view of FIG. 2 in the released position with fragments breaking loose.
Figure 4:
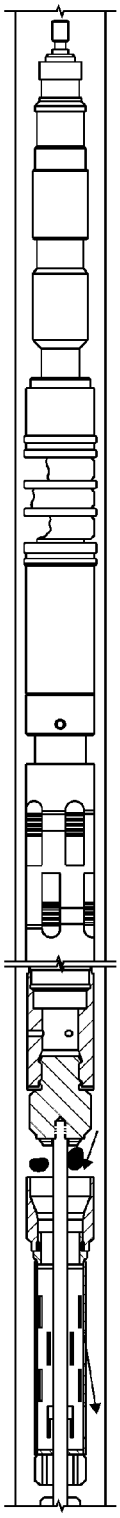
FIG. 4 shows the fragments going into the basket.

The FIG. illustrates schematically a borehole tubular 10 that has a series of sliding sleeves 12, 14 and 16 where each respectively has ball seats 18, 20 and 22 that get progressively larger. Progressively larger balls 24, 26 and 28 are dropped and landed as shown to shift the sleeves 12, 14 and 16 in order in a direction toward the surface so that ports 30, 32 and 34 can be opened for sequential fracking in a manner that is known in the art. While three sleeves are shown typical frac jobs can involve over several dozen balls or objects of varying size to complete the zone that needs fracking. This portion of the FIG. provides the backdrop for the preferred use of the invention that is to be described below.

Typically before the fracking begins with all the sleeves 12, 14 and 16 closed, a retrievable plug 36 is delivered on a variety of conveyances with a setting mechanism. The plug 36 can be delivered on wireline, electric line, coiled tubing or jointed tubing schematically illustrated as 38 to name a few examples. The plug 36 typically has a sealing assembly schematically represented as 38 that includes an annular elastomeric or other material annular seal and optionally slips above or below the seal or both. A setting tool schematically illustrated as S creates relative movement of a setting sleeve relative to a mandrel of the plug 36 to longitudinally compress and radially extend the sealing assembly. The resilient seal has its length decreased and its diameter increased into contact with the surrounding tubular 10. The setting process increases the internal pressure in the seal and applied differential pressure on the set plug 36 further increases in applied internal pressure in the seal of the element assembly 38. As a result when the plug is released as shown in the FIG. chunks of the sealing element such as 40 and 42 can break off.

Those skilled in the art will realize that the fragments 40 or 42 if not captured can land in ball seats 18, 20 or 22 so that a seal with a dropped ball is prevented. This can prevent the sleeves 12, 14 and 16 from shifting to open their associated ports and the fracturing job can be prevented from occurring. Additionally, if the debris is large enough the premature actuation of sleeves 12,14 and 16 may occur. Instead the fragments 40 or 42 have to be fished out if possible to avoid an expensive fishing operation of the well that may not be cost effective and cause the well to need to be abandoned in an extreme case.

The present invention has several features to prevent the fragments 40 or 42 from getting to the ball seats 12, 14 and 16. Attached to the plug mandrel 44 is a support preferably an elongated rod 46 with a breakaway 48 and a fishing neck 50. One or more struts 52 or 54 leave an open top 56 for the basket 58 that has openings for fluid flow 60 that are smaller than the size of the fragments 40 and 42 so that the fragments 40 and 42 remain in the basket 58 as the basket 58 is raised and fluid flows through the openings 60 as the closed bottom 62 retains the fragments 40 and 42 inside the basket 58. There can also be openings in the bottom 62. As another option spring loaded fingers 61 can be used so that the weight of the fragments 40 and 42 displaces the fingers while the spring loading returns the fingers 61 to a position where the collected fragments 40 and 42 cannot escape. The shape of the basket 58 is preferably cylindrical with a dimension slightly smaller than the drift dimension of the tubular 10 to allow rapid deployment of the plug 36. The spacing between the plug 36 and the top 56 of the basket 58 is preferably kept short to reduce the overall length of the assembly so that it can clear bends in a deviated wellbore that is frequently the case when fracturing takes place. Spacing distance of a meter or less is preferred.

If the basket 58 becomes detached it will most likely be at rod 46 preferably above the fishing neck 50 so that a fishing tool can be used to retrieve the assembly. The application of the basket is normally in a horizontal run so that the basket will not free fall. If the basket 58 is in a deviated or vertical well then it will fall to the topmost ball seat and stop there. The seat itself is recessed and shear pinned so that the impact on it from the basket 58 should not damage the ball seat for subsequent use or break the shear pin so that the ball seat is still functional for its intended purpose.

Another optional feature is schematically represented as 66 and its purpose is to limit relative movement between the mandrel 44 and the setting sleeve that is moved by the setting tool S. In this way the amount of rubber pressure created during the setting process can be limited while still getting a seal as one way to discourage the formation of chunks 40 and 42 from even forming. This travel stop can also be optionally effective under differential pressure loading after the packer is set to prevent undue addition to the rubber pressure on the sealing element of assembly 38 again with the same objective of minimizing the formation of debris that can fall after the plug 36 is unset as shown in the FIG.

Those skilled in the art will appreciate that a simple solution to a potentially devastating problem that has heretofore existed is presented by the present invention. Any portions of the sealing element that break off during use are prevented from falling further into the wellbore with the basket device that is supported by the plug. The basket has flow openings to avoid swabbing the well on removal while still retaining the debris therein. As an option flexible fingers can also be added to the inlet of the basket to keep the debris inside should there be a change in movement direction. The basket can also include peripheral flexible seals 68 to keep debris from wedging around the basket and against the surrounding tubular. The basket has a fishing neck and a breakaway so that if it gets stuck the plug can still come out and the basket will not free fall due to a brake. A fishing tool can then attempt to retrieve it by grasping it on the fishing neck. The amount of sealing element compression can be limited with a travel stop for the setting sleeve in its motion relative to the mandrel with the stop also acting to limit the rubber pressure during differential pressure loading in an effort to minimize breaking off of rubber from the sealing element. While an application for fracturing is illustrated the present invention has further applicability for other situations where it is undesirable to allow components of a well barrier to drop further into a wellbore.

In this application the terms plug, packer and barrier are used interchangeably for devices that can isolate one portion of the wellbore for another and which can further have a wide array of components for gripping.

The above description is illustrative of the preferred embodiment and many modifications may be made by those skilled in the art without departing from the invention whose scope is to be determined from the literal and equivalent scope of the claims below:

We claim:

1. A subterranean barrier assembly for a borehole defined by a wall, comprising:

a selectively actuated barrier assembly having an annularly shaped sealing element engageable with the wall, said barrier assembly actuated with a separable setting tool to compress said sealing element and creating internal pressure within said sealing element;

said barrier assembly placed uphole of at least one seat to allow performance of a pressure integrity test from a surface location against said barrier assembly when set in the borehole;

a debris catcher supported proximately to said barrier assembly to retain falling debris that breaks loose from said sealing element, said debris catcher and said barrier assembly are delivered into the borehole together for the performance of said pressure integrity test whereupon said barrier assembly and said debris catcher are removed from the borehole together to expose said at least one seat to sealingly accept an object for performing a formation pressure treatment;

said barrier assembly comprises a travel stop to limit the compression on said sealing element to reduce the formation of fragments of said sealing element to be captured by said debris catcher and protect said seat from said fragments that can interfere with said object sealingly contacting said seat.

2. The assembly of claim 1, wherein:

said debris catcher comprises an open top basket.

3. The assembly of claim 2, wherein:

said basket has openings retaining said debris while allowing fluid to flow therethrough.

4. The assembly of claim 3, wherein:

said basket comprises a peripheral seal in contact with the wall adjacent said open top.

5. The assembly of claim 4, wherein:

said debris catcher is releasably connected to said barrier assembly.

6. The assembly of claim 5, wherein:

said releasable connection comprises a support rod selectively attached to a mandrel of said barrier assembly;

said rod further comprises a fishing neck.

7. The assembly of claim 6, further comprising: a plurality of axially spaced openings in a tubular that defines the wall; a plurality of sliding sleeves associated with said openings, each of said sleeves having one of the at least one seats for sequential landing of objects for pressure actuation of said sleeves.

8. The assembly of claim 7, wherein:

said debris catcher has a retainer that allows debris to enter while retaining said debris therein.

9. The assembly of claim 4, wherein:

said releasable connection comprises a breakaway connection that parts under tensile loading.

10. The assembly of claim 2, wherein:

said basket is cylindrically shaped.

11. The assembly of claim 10, wherein:

said basket comprises a peripheral seal in contact with the wall adjacent said open top.

12. The assembly of claim 1, wherein:

said debris catcher is releasably connected to said barrier assembly.

13. The assembly of claim 12, wherein:

said releasable connection comprises a breakaway connection that parts under tensile loading.

14. The assembly of claim 12, wherein:

said releasable connection comprises a support rod selectively attached to a mandrel of said barrier assembly;

said rod further comprises a fishing neck.

15. The assembly of claim 1, further comprising: a plurality of axially spaced openings in a tubular that defines the wall; a plurality of sliding sleeves associated with said openings, each of said sleeves having one of the at least one seats for sequential landing of objects for pressure actuation of said sleeves.

16. The assembly of claim 1, wherein:

said debris catcher has a retainer that allows debris to enter while retaining said debris therein.

17. The assembly of claim 16, wherein:

said retainer allows debris to enter when a spring bias is overcome and retains the debris when the spring bias repositions said retainer.

* * * * *